US005826468A

United States Patent [19]

Daubinger et al.

[11] Patent Number: 5,826,468

[45] Date of Patent: Oct. 27, 1998

[54] TRANSPORTING DEVICE FOR A STRIP-SHAPED MAGAZINE FEEDING ATTACHMENT FOR SCREWS

[75] Inventors: Gerd Daubinger, München, Germany; Hendrik A. van Egeraat, Örebro, Sweden

[73] Assignee: Hilti Aktiengesellschaft, Schaan, Liechtenstein

[21] Appl. No.: 669,658

[22] Filed: Jun. 24, 1996

[30] Foreign Application Priority Data

Jun. 23, 1995 [DE] Germany ..... 195 22 815.4

[51] Int. Cl.[6] ..... B25B 23/04

[52] U.S. Cl. ..... 81/434; 81/433; 81/57.37

[58] Field of Search ..... 81/57.37, 431, 81/433, 434, 435; 227/135, 136, 138, 142

[56] References Cited

U.S. PATENT DOCUMENTS

| | | | |
|---|---|---|---|
| 4,062,388 | 12/1977 | DeCaro . | |
| 4,146,071 | 3/1979 | Mueller et al. | 81/434 |
| 4,821,937 | 4/1989 | Rafferty | 227/142 |
| 4,923,719 | 5/1990 | Kross et al. | 81/57.37 |
| 5,568,753 | 10/1996 | Habermehl et al. | 81/434 |
| 5,570,618 | 11/1996 | Habermehl et al. | 81/434 |
| 5,593,079 | 1/1997 | Mukoyama et al. | 227/142 |

FOREIGN PATENT DOCUMENTS

| | | | |
|---|---|---|---|
| 1603827 | 6/1971 | Germany | 227/142 |

*Primary Examiner*—David A. Scherbel
*Assistant Examiner*—Joni B. Danganan
*Attorney, Agent, or Firm*—Anderson, Kill & Olick, P.C.

[57] ABSTRACT

A transporting device for a strip-shaped magazine feeding attachment (3) for screws includes a housing (1) of a screw driving apparatus, a guide element (2) at a front end of the housing and displacable relative to the housing in the screw-setting direction. A stop element (8) and a transporting channel (15) for the magazine feeding attachment (3) for screws extending substantially perpendicularly to the screw-setting direction. The stop element (8) can be displaced relative to the guiding element (2) in the screw-setting direction. The transporting channel (15) extending substantially perpendicularly to the screw-setting direction and being formed by the guiding element (2) and the stop element (8) between which the magazine feeding attachment (3) can be clamped.

2 Claims, 1 Drawing Sheet

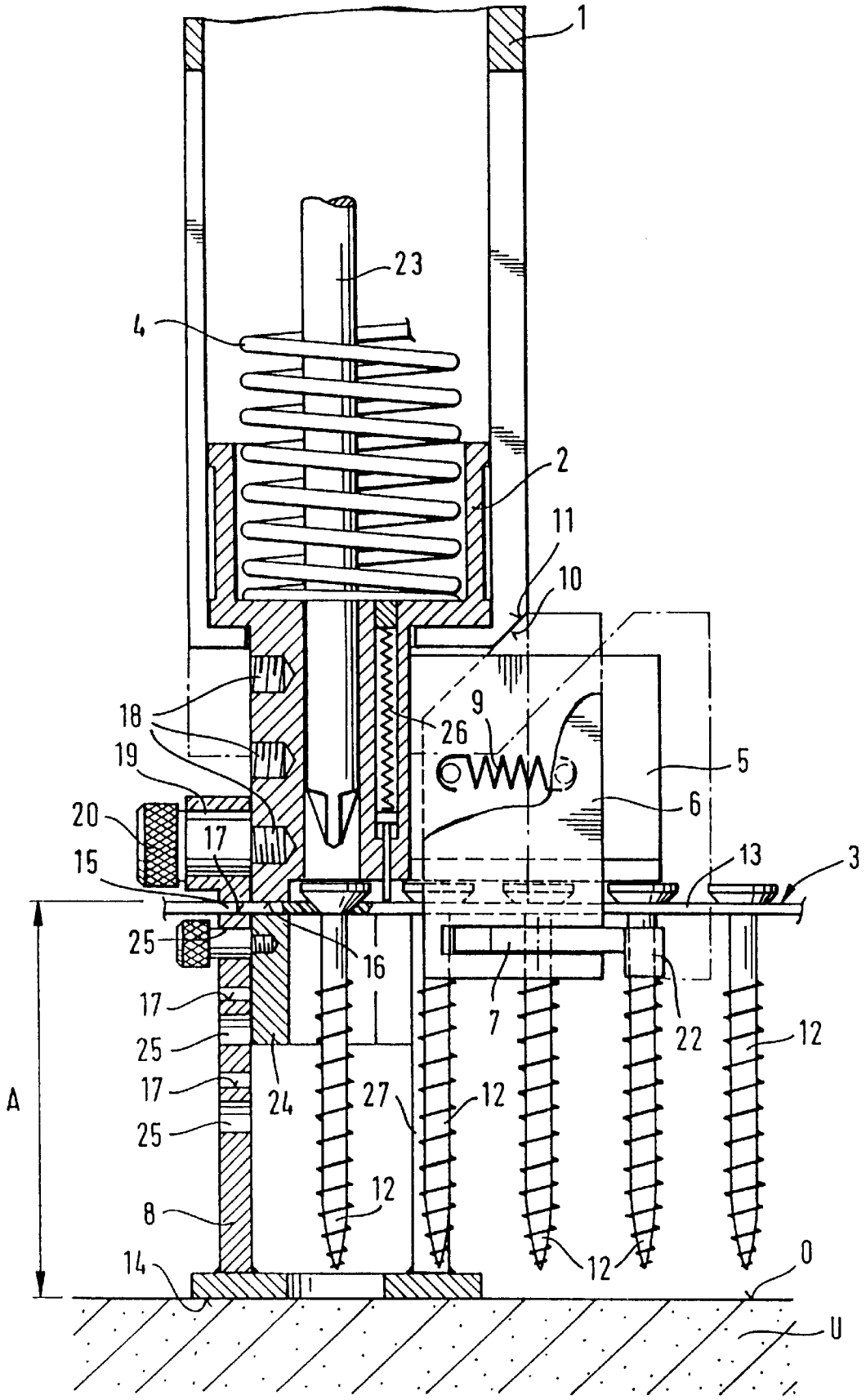
1
23
4
2
11
10
18
9
26
19
5
20
17
6
15
13
3
25
16
17
7
22
12
25
17
24
27
12
A
25
12
8
12
14
0
U

TRANSPORTING DEVICE FOR A STRIP-SHAPED MAGAZINE FEEDING ATTACHMENT FOR SCREWS

BACKGROUND OF THE INVENTION

The present invention is directed to a transporting device for a strip-shaped feeding attachment for screws including a housing, a guiding element, which can be shifted relative to the housing, parallel to the screw setting direction and counter to the force of a spring, a stop element with a stop surface formed at the leading end of the transport device in the screw setting direction and a transporting channel for the magazine feeding attachment for screws extending substantially perpendicularly to the screw-setting direction.

In the European patent 0 593 970 acting in combination with a screwing device, a transporting device for a strip-shaped magazine feeding attachment for screws comprises a housing and a guiding element which can be shifted relative to the housing parallel to the screw-setting direction and against the force of a spring, and a slide with a transporting catch or pawl which can be moved against the force of another spring essentially at right angles to the screw-setting direction. In its interior, the housing has a cam interacting with a roller disposed on the slide, when the housing is moved relative to the guiding element in the screw-setting direction. At the same time, the slide, constructed in the form of a two armed lever, is pivoted about a fulcrum disposed on the guiding element and the free end of the slide experiences a swivelling motion which brings about the shifting of the spring loaded transporting catch located at the slide essentially at right angles to the screw-setting direction. After the transporting catch or pawl has gripped behind the shaft of the screw, the strip-shaped magazine feeding attachment for screws is moved in the direction of the guiding element when the housing moves counter to the screw setting direction relative to the guiding element, and the slide assumes its position of rest once again. The transporting path of the magazine feeding attachment of screws corresponds to the distance between two screws disposed in the magazine feeding attachment.

The pretensioning of this known transporting catch is possible only when the magazine feeding attachment for the screws is fixed with respect to the guiding element, so that the magazine feeding attachment does not move with the slide. Accordingly, the strip-shaped magazine feeding attachment for screws is used for this known transporting device, the strip of which is provided on the long sides with indentations, which can interact with a ratchet disposed in the transporting channel. If such a magazine feeding attachment for screws is supplied to the transporting channel, then the ratchet is turned outward against the force of a spring, until it can move into a corresponding indentation in the long side of the magazine for the screws. The ratchet is constructed so that it can rotate in only one direction, whereby locking in the opposite direction results. In this way, the magazine feeding attachment is fixed relative to the guiding element, when the slide is moved and the transporting catch pretensioned. This known ratchet with the corresponding mechanism is complicated in its structure and can be installed only with great effort, whereby the transporting device as a whole cannot be produced economically. Moreover, provisions for engaging the ratchet must be made at the magazine attachment for the screws.

SUMMARY OF THE INVENTION

Therefore, it is the primary object of the present invention to provide a transporting device for a strip-shaped magazine feeding attachment, which can be connected to a screwing device or a screw driving device, can be produced economically, enables a simply constructed magazine feeding attachment with the screws to be used and is easily dismounted for cleaning and maintenance work.

In accordance with the present invention, the stop element can be shifted relative to the guiding element and parallel to the screw setting direction and the wall parts of the transporting channel, extending substantially perpendicularly to the screw-setting direction, are formed by parts of the guiding element and of the stop element. Accordingly, when the housing is moved in the screw-setting direction relative to the guiding element, the strip-shaped magazine feeding attachment for screws, disposed in the transport channel, is clamped, so that any shifting of the magazine feeding attachment during movement of the slide is prevented. The manufacture of the transporting device is economical because of the simple structure of the individual parts.

Preferably, the transporting channel is formed by stop parts of the stop element facing opposite to the screw-setting direction and by the leading end of the guiding element, facing in the screw-setting direction. The clear cross section of the through passageway corresponds at least to the cross section of the magazine feeding attachment for screws.

For use with screws of different lengths, in the transporting device of the present invention the distance between the leading end of the guide element and the stop element is advantageously adjustable in steps, the stop element having several stop parts arranged one after the other in the axial or screw-setting direction.

Effective clamping of the magazine feeding attachment between the stop element and the guiding element is achieved owing to the fact that the clamping element, which interacts with the front end of the guide element, can be axially fixed in a stepwise manner at the stop element. The clamping element is disposed, for example, in the interior of the stop element and is firmly connected with the stop element by means of a fastening element, such as a screw.

For functional reasons, a spring element is advisably disposed between the guiding element and the stop element.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWINGS

The drawing is an elevational view, partly in section, of a transporting device for the screws shown positioned at the front or leading end of a screw driving device, not otherwise shown.

DETAILED DESCRIPTION OF THE INVENTION

The screw driving device has a housing 1 with a axially extending guiding element 2 mounted in and extending outwardly from the leading end of the housing with a spring 4 located in the housing. A transporting rail 5 is located at the guiding element 2 and extends outwardly from the guiding element with a slide 6, a spring-loaded transporting catch or pawl 7 and a stop element 8.

At its upper end, the guiding element 2 is mounted in and projects out from the leading end of the housing 1 in the screw-setting direction. The guiding element 2 can be shifted axially against the force of the spring 4, disposed between the housing 1 and the guiding element 2. The transporting rail 5, along with the slide 6, can be shifted against the force of another spring 9 extending at right angles relative to the screw setting direction and extending away from the guiding element 2.

Slide 6 is shifted as a function of the position of the guiding element 2 relative to the housing 1. On the screw-setting side or leading end of the housing 1, a cam surface 10 tapers inwardly in the screw-setting direction and interacts with a corresponding countersurface 11 on the slide 6 when a screw 12 is being driven or set, the housing 1 is moved in the screw-setting direction relative to the guiding element 2. The inclined cam surface 10 disposed on the housing 1 slides on the corresponding countersurface 11 on the slide 6 and shifts or displaces the slide at right angles to the screw-setting direction outwardly away from the guiding element 2. When shifted relative to a screw 12, a spring-loaded transporting catch 7, disposed behind the slide 6, is pretensioned, gripping behind the screw as soon as the transporting catch no longer lies against the shaft of the other screw 12.

Transporting catch 7 has a wing 22 so that it is possible to grasp it manually and swivel the transporting catch 7.

Pretensioning the transporting catch 7 is possible only when the strip 13 of the magazine feeding attachment can be fixed relative to the guide element 2 so that the strip 13 does not move along with the slide 6. For this purpose, there is an axially extending sleeve-like stop element 8 extending from the guiding element 2 in the screw-setting direction with a stop surface 14 at its leading end, several stop parts 17 extending at right angles to the screw-setting direction and spaced one after the other in the axial direction, that is the screw-setting direction, along with a clamping element 24 located within the stop element. The clamping element 24 can be fixed relative to the guiding element 2, so that the surface of the clamping element 24 facing opposite to the screw-setting direction, in each case lies in the same plane as the stop part 17 of the stop element 8 which faces opposite to the screw-setting direction and are located in the region of the through holes 25. The through holes 25 are arranged in combination with the stop parts 17, note in the drawing that each stop part 17 has an associated through hole 25.

The stop element 8 laterally encloses a portion of the guiding element 2 and can be shifted axially relative to the guiding element and fixed to the guiding element by means of a fastening element 20 in the form of a screw extending into a hole 18 in the guiding element. A number of holes 18 are spaced apart in the guiding element in the axial direction thereof. The distance A between the front or leading end 16 of the guiding element 2 and the stop surface 14 of the stop element 8 can be adjusted stepwise due to the spaced arrangement of the holes 18. The fastening element 20 extends through an elongated hole 19 formed in the trailing end part of the stop element 8 with the elongation of the hole extending parallel to the screw-setting direction and the width of the elongation is slightly larger than the shaft diameter of the fastening element 20. On the opposite side of the stop element from the elongated hole, the stop element 8 has an axially extending slot 27 extending at least partially over the axial length of the stop element so that a screw 12 can be inserted into the interior of the stop element 8.

When the transporting device is pressed against a surface O of a receiving or base material U into which a screw is to be fastened, the leading end 16 of the guide element and the stop parts 17 of the guiding channel 15 extending transversely of the screw-setting direction and located at the stop element 8 move towards one another and clamp the strip 13 of the magazine feeding attachment 3 for screws which lies between them. After a screw 12 is driven in by means of a screwdriver blade 23 in the screw driving device, the screw driving device is lifted from the receiving material U so that the stop element 8 with the help of the spring element 26 moves relative to the guiding element 2 again in the screw-setting direction. At the same time that the screw stop element 8 is shifted, the housing 1 is also shifted relative to the guiding element, as is the slide 6 which is pretensioned by the inclined surface 10 acting on the counter surface 11, together with the screws 12 held in the magazine feeding attachment 3.

While specific embodiments of the invention have been shown and described in detail to illustrate the inventive principles, it will be understood that the invention may be embodied otherwise without departing from such principles.

We claim:

1. A transporting device for use with a screw driving apparatus including a strip-shaped magazine feeding attachment (3) for screws (12), a housing (1) for the screw driving apparatus having a front end facing in a screw setting direction, a guiding element (2) mounted in and extending axially outwardly in the screw-setting direction from the front end of said housing, said guiding element (2) being displacable relative to said housing (1) parallel to the screw setting direction counter to the force of a first spring (4), a stop element (8) extending in the screw-setting direction ahead of the front end of said housing (1) and having a stop surface (14) at a front end thereof in the screw setting direction spaced axially outwardly from said guiding element (2), a transporting channel (15) for said magazine feeding attachment (3) for screws extending substantially perpendicularly to the screw-setting direction, said stop element (8) being at least partially coextensive with said guiding element (2) and being displacable in the screw-setting direction relative to said guiding element, said transporting channel (15) having first and second surfaces extending substantially perpendicularly to the screw-setting direction and said first and second surfaces being formed by parts of said guiding element (2) and of the said stop element (8), said transporting channel (15) being formed by stop surfaces (17) on said stop element (8) facing opposite to the screw-setting direction and by a front end surface (16) of said guiding element (2) spaced axially outwardly from said front end of said housing and facing in the screw setting direction wherein a distance (A) between the front end surface (16) of said guiding element (2) and said stop surface (14) of said stop element (8) can be step wise adjusted whereby said stop element (8) has a hole (19) therethrough adjacent a trailing end thereof in the setting direction, and said guiding element (2) has a number of holes (18) therein spaced apart in the setting direction, a fastening element (20) extending through said hole (19) in said stop element (8) into one of said holes (18) in said guiding element (2) for the stepwise adjustment, and said stop element (8) has a number of through holes (25) spaced apart in the setting direction along with an adjacent said stop surface (17) facing opposite to the screw-setting direction associated with each said through hole (25) and spaced from an inside surface of the associated through hole opposite to the setting direction, a clamping element (24) located within said stop element (8) and interacting with the leading end surface (16) of said guiding element (2), said clamping element (24) is axially fixable in axially stepped locations with said through holes (25) in said stop element so that an end surface of said clamping element (24) facing opposite of the setting direction is in the same plane with said stop surface (17) associated with said through holes (25) of said stop element (24) to which said clamping element is fixed.

2. A transporting device, as set forth in claim 1, wherein a spring member (26) is located in said guiding element (2) extending in the screw setting direction and co-acting with said stop element (8) for effecting movement of said stop element in the setting direction relative to said guiding element (2).

* * * * *